US010197962B2

(12) United States Patent
Hashimoto

(10) Patent No.: US 10,197,962 B2
(45) Date of Patent: Feb. 5, 2019

(54) IMAGE PROCESSING APPARATUS

(71) Applicant: Konica Minolta, Inc., Tokyo (JP)

(72) Inventor: Yusuke Hashimoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/897,619

(22) Filed: Feb. 15, 2018

(65) Prior Publication Data

US 2018/0246454 A1 Aug. 30, 2018

(30) Foreign Application Priority Data

Feb. 28, 2017 (JP) ..... 2017-037292

(51) Int. Cl.
*G03G 15/00* (2006.01)
*G03G 21/16* (2006.01)

(52) U.S. Cl.
CPC ..... *G03G 15/5087* (2013.01); *G03G 21/1604* (2013.01); *G03G 2215/00016* (2013.01); *G03G 2215/00109* (2013.01)

(58) Field of Classification Search
CPC ..... G03G 21/1604
See application file for complete search history.

(56) References Cited

U.S. PATENT DOCUMENTS 6,415,118 B1 * 7/2002 Setoriyama ..... B41J 11/0085 347/170
2005/0206962 A1 * 9/2005 Nakayama ..... G03G 15/50 358/448
2010/0231390 A1 * 9/2010 Hashimoto ..... G03G 15/5004 340/573.1
2013/0128298 A1 * 5/2013 Yamada ..... G06K 15/02 358/1.13

FOREIGN PATENT DOCUMENTS

JP 2005278172 A 10/2005
JP 2013147015 A 8/2013

* cited by examiner

*Primary Examiner* — Clayton E Laballe
*Assistant Examiner* — Jas Sanghera
(74) *Attorney, Agent, or Firm* — Lucas & Mercanti, LLP

(57) ABSTRACT

An image processing apparatus includes: a casing that includes a plurality of peripheries and a plurality of corners connecting mutually adjacent peripheries; and a first antenna and a second antenna that are attached on the casing, wherein the first antenna and the second antenna are arranged at a first corner closest to the first antenna and at a second corner closest to the second antenna, respectively, and the mutually adjacent peripheries forming the first corner and the mutually adjacent peripheries forming the second corner are mutually different.

15 Claims, 16 Drawing Sheets

IMAGE PROCESSING APPARATUS

The entire disclosure of Japanese patent Application No. 2017-037292, filed on Feb. 28, 2017, is incorporated herein by reference in its entirety.

BACKGROUND

Technological Field

The present invention relates to an image processing apparatus.

Description of the Related Art

JP 2013-147015 A and JP 2005-278172 A are listed as documents in which an image forming apparatus including a conventional image processing apparatus is disclosed, for example.

The image forming apparatus disclosed in JP 2013-147015 A is provided with a plurality of antennas in a casing such that the normal directions of the surfaces on which the antennas are arranged are mutually different. Thereby, when a user approximates a communication terminal to the casing, data transmitted in near-distance wireless communication cannot be received by one antenna due to a posture of the communication terminal but is likely to be received by other antenna.

The image forming apparatus disclosed in JP 2005-278172 A is provided with a main antenna and a sub-antenna on a back face of a casing, and a wireless LAN module is incorporated in the back face of the casing. The main antenna and the sub-antenna are the shortest connected to the wireless LAN module via cables, respectively.

In the image forming apparatus disclosed in JP 2013-147015 A, however, even if reception by one antenna is impossible due to a posture of a communication terminal, reception by other antenna is possible, and positions at which a communication terminal is approximated to the casing are specified in a certain range. Thus, when a communication terminal is approximated to an unintended position, communication with the communication terminal can be disabled.

Further, in the image forming apparatus disclosed in JP 2005-278172 A, the positions where the main antenna and the sub-antenna are installed are limited on the back face of the casing. Thus, communication from the back face of the casing can be relatively stable, but communication with a communication apparatus in front of the casing is difficult to stabilize.

SUMMARY

The present invention has been made in view of the above problems, and an object of the present invention is to provide an image processing apparatus capable of enhancing accuracy of communication.

To achieve the abovementioned object, according to an aspect of the present invention, an image processing apparatus reflecting one aspect of the present invention comprises: a casing that includes a plurality of peripheries and a plurality of corners connecting mutually adjacent peripheries; and a first antenna and a second antenna that are attached on the casing, wherein the first antenna and the second antenna are arranged at a first corner closest to the first antenna and at a second corner closest to the second antenna, respectively, and the mutually adjacent peripheries forming the first corner and the mutually adjacent peripheries forming the second corner are mutually different.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
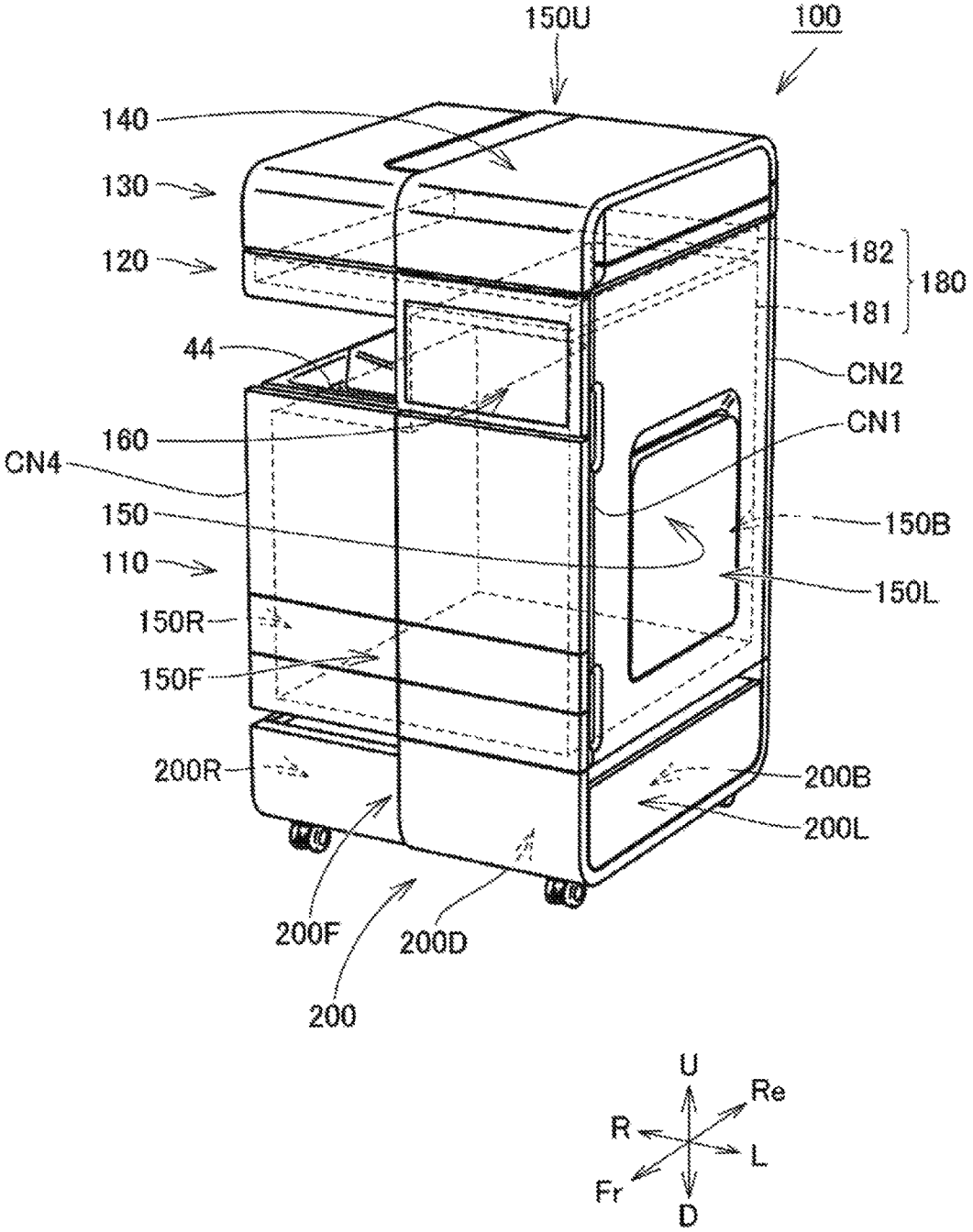
FIG. 1 is a perspective view of an image processing apparatus according to a first embodiment.

Hereinafter, one or more embodiments of the present invention will be described in detail with reference to the drawings. However, the scope of the invention is not limited to the disclosed embodiments. The same or common parts are denoted with the same reference numerals in the embodiments described below, and a description thereof will not be repeatedly made.

In the drawings, the arrows U and D indicate a vertical direction, the arrows L and R indicate a right-left direction of an image processing apparatus, and the arrows Fr and Re indicate a front-back direction of an image processing apparatus.

First Embodiment

Figure 2:
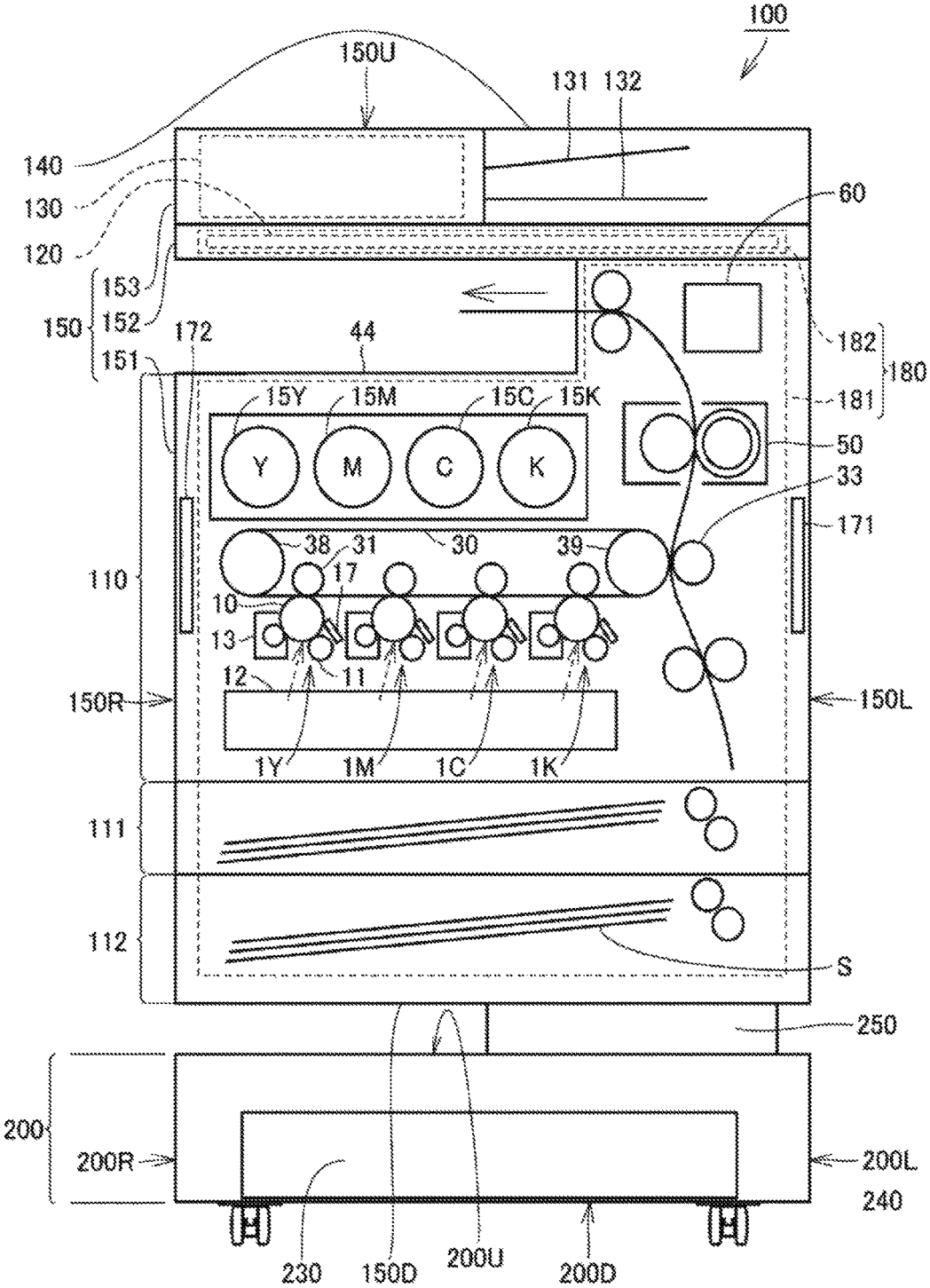
FIG. 2 is a schematic diagram of the image processing apparatus according to the first embodiment.

FIG. 1 is a perspective view of an image processing apparatus according to a first embodiment. FIG. 2 is a schematic diagram of the image processing apparatus according to the first embodiment. An image processing apparatus 100 according to the first embodiment will be described with reference to FIG. 1 and FIG. 2.

As illustrated in FIG. 1 and FIG. 2, the image processing apparatus 100 includes a casing 150, a first antenna 171 (see FIG. 2), a second antenna 172 (see FIG. 2), a shield member 180, and a server apparatus 200. The image processing apparatus 100 further includes an image former 110, an image reader 120, a document feeder 130, a cover member 140, and an operation panel 160.

The entire outer shape of the casing 150 is substantially a cuboid shape. The casing 150 includes a plurality of peripheries and a plurality of corners connecting mutually adjacent peripheries. Specifically, the casing 150 includes four peripheries and four corners.

The casing 150 has a front face 150F, a back face 150B, a right side face 150R, a left side face 150L, an upward face 150U, and a downward face 150D (see FIG. 2) as well as a corner CN1, a corner CN2, a corner CN3 (see FIG. 3) and a corner CN4.

The front face 150F, the back face 150B, the right side face 150R, and the left side face 150L correspond to the four peripheries, and the corners CN1, CN2, CN3, and CN4 correspond to the four corners.

The mutually adjacent front face 150F and left side face 150L are connected via the corner CN1. The mutually adjacent left side face 150L and back face 150B are connected via the corner CN2. The mutually adjacent back face 150B and right side face 150R are connected via the corner CN3. The mutually adjacent right side face 150R and front face 150F are connected via the corner CN4.

The casing 150 houses the image former 110, the image reader 120, and the document feeder 130 therein. The casing 150 includes a first casing part 151, a second casing part 152, a third casing part 153, a cassette 111, and a cassette 112.

The first casing part 151 houses the image former 110 therein. The second casing part 152 houses the image reader 120 therein. As vertically viewed, the outer shape of the first casing part 151 almost matches with the outer shape of the second casing part 152. As vertically viewed, the center of the first casing part 151 almost matches with the center of the second casing part 152.

The third casing part 153 houses the document feeder 130 therein. The cassette 111 and the cassette 112 house therein recording mediums S forming an image thereon. The cassette 111 and the cassette 112 configure the lower part of the casing 150.

The casing 150 has a concave part 44 which is configured by depressing part of peripheries in the horizontal direction in the middle of the vertical direction. Specifically, the concave part 44 is formed by depressing part of the right side face and part of the front face of the casing 150 from the front right corner of the casing 150. A recording medium printing an image formed by the image former 110 thereon is discharged to the concave part 44. The concave part 44 functions as a sheet discharging section.

The operation panel 160 is provided on the casing 150. The operation panel 160 is provided on the front face 150F of the casing 150. The operation panel 160 is provided on the upper side of the first casing part 151. The operation panel 160 is rotatably provided about a rotation shaft rotating in the right-left direction.

The operation panel 160 includes a display section integrated with a touch sensor. The surface of the operation face of the operation panel 160 configures part of the front face 150F of the casing 150.

The document feeder 130 is arranged above the image reader 120. The document feeder 130 is arranged on the right side of the upper part of the image processing apparatus 100. The document feeder 130 feeds a document supplied to a supply tray 131 to a discharge tray 132 via the document reading position of the image reader 120.

The supply tray 131 and the discharge tray 132 protrude from the third casing part 153 toward the left side of the image processing apparatus 100. The supply tray 131 and the discharge tray 132 are provided to vertically overlap.

The cover member 140 covers the supply tray 131 and the discharge tray 132 to be able to switch between a covered state in which the supply tray 131 and the discharge tray 132 are covered and a non-covered state in which the supply tray 131 and the discharge tray 132 are not covered. The cover member 140 is configured to be axially rotatable with a direction parallel to the right-left direction as axial direction.

The image reader 120 is arranged above the image former 110. The image reader 120 reads image information of a document placed on a document table.

The image former 110 forms an image on the basis of a control signal from a controller 60 described below. The image former 110 forms an image of the document read by the image reader 120.

The image former 110 includes image forming units 1Y, 1M, 1C, and 1K, an intermediate transfer belt 30, a primary transfer roller 31, a secondary transfer roller 33, a driven roller 38, a driving roller 39, a timing roller 40, a fixing apparatus 50, and the controller 60.

The image forming units 1Y, 1M, 1C, and 1K are sequentially arranged along the intermediate transfer belt 30. The image forming unit 1Y is supplied with a toner from a toner bottle 15Y thereby to form a yellow (Y) toner image. The image forming unit 1M is supplied with a toner from a toner bottle 15M thereby to form a magenta (M) toner image. The image forming unit 1C is supplied with a toner from a toner bottle 15C thereby to form a cyan (C) toner image. The image forming unit 1K is supplied with a toner from a toner bottle 15K thereby to form a black (K) toner image.

Each of the image forming units 1Y, 1M, 1C, and 1K includes a photosensitive body 10, a charging apparatus 11, an exposure apparatus 12, a development apparatus 13, and a cleaning apparatus 17.

The charging apparatus 11 uniformly charges the surface of the photosensitive body 10. The exposure apparatus 12 irradiates the photosensitive body 10 with a laser light in response to a control signal from the controller 60, and exposures the surface of the photosensitive body 10 according to an input image pattern. Thereby, an electrostatic latent image is formed on the photosensitive body 10 according to the input image.

The development apparatus 13 applies a development bias to a development roller 14 and attaches a toner on the surface of the development roller 14 while rotating the development roller 14. Thereby, the toner is transferred from the development roller 14 onto the photosensitive body 10, and a toner image based on the electrostatic latent image is developed onto the surface of the photosensitive body 10.

The photosensitive body 10 and the intermediate transfer belt 30 contact each other at a part where the primary transfer roller 31 is provided. The primary transfer roller 31 has a roller shape and is configured to be rotatable. A transfer voltage with a reverse polarity to a toner image is applied to the primary transfer roller 31 so that the toner image is transferred from the photosensitive body 10 onto the intermediate transfer belt 30.

A yellow (Y) toner image, a magenta (M) toner image, a cyan (C) toner image, and a black (K) toner image are sequentially overlapped and transferred from the photosensitive body 10 onto the intermediate transfer belt 30. Thereby, a color toner image is formed on the intermediate transfer belt 30.

The intermediate transfer belt 30 is crossed between the driven roller 38 and the driving roller 39. The driving roller 39 is rotated and driven by a motor (not illustrated), for example. The intermediate transfer belt 30 and the driven roller 38 rotate along with the driving roller 39. Thereby, a toner image on the intermediate transfer belt 30 is fed to the secondary transfer roller 33.

The cleaning apparatus 17 is pressurized onto the photosensitive body 10. The cleaning apparatus 17 collects a toner remaining on the surface of the photosensitive body 10 after a toner image is transferred.

Recording mediums such as sheets are housed in the cassettes 111 and 112. The recording mediums S are fed one by one by the timing roller from the cassette 111 or the cassette 112 to the secondary transfer roller 33 along a feeding path 41.

The secondary transfer roller 33 has a roller shape and is configured to be rotatable. The secondary transfer roller 33 applies a transfer voltage with a reverse polarity to a toner image onto a recording medium being fed. Thereby, the toner image is attracted from the intermediate transfer belt 30 to the secondary transfer roller 33 and the toner image on the intermediate transfer belt 30 is transferred.

A timing to feed the recording mediums S to the secondary transfer roller 33 is adjusted by the timing roller according to a position of a toner image on the intermediate transfer belt 30. A toner image on the intermediate transfer belt 30 is transferred onto an appropriate position of the recording medium S by the timing roller.

The fixing apparatus 50 pressurizes and heats the recording medium S passing therethrough. Thereby, a toner image is fixed on the recording medium S. Thereafter, the recording medium S is discharged to the concave part 44 as a sheet discharging section.

The shield member 180 shields an electromagnetic wave. Specifically, the shield member 180 restricts an electromagnetic wave generated by the image former 110 and the image reader 120 from leaking to the outside of the casing 150. The shield member 180 restricts a jamming wave from entering from the outside of the casing 150.

The shield member 180 has a first shield member 181 and a second shield member 182. The first shield member 181 houses the image former 110 therein. The first shield member 181 is housed in the first casing part 151. The first shield member 181 is configured such that a thin steel plate as electromagnetic wave shielding member is arranged along the inner surface of the first casing part 151.

The second shield member 182 houses the image reader 120 therein. The second shield member 182 is housed in the second casing part 152. The second shield member 182 is configured such that a thin steel plate as electromagnetic wave shielding member is arranged along the inner surface of the second casing part 152.

The first antenna 171 and the second antenna 172 have a rod shape, for example. The first antenna 171 and the second antenna 172 vertically extend. The first antenna 171 and the second antenna 172 are arranged inside the first casing part 151, for example. The first antenna 171 and the second antenna 172 are arranged above the cassettes 111 and 112, for example.

The first antenna 171 and the second antenna 172 are configured to be wirelessly communicable with communication apparatuses outside the casing 150, for example. The first antenna 171 and the second antenna 172 are communicable with communication apparatuses positioned outside the casing 150 by use of Wi-Fi communication or wireless LAN communication, for example. The communication apparatuses include the server apparatus 200.

Image data received from a communication apparatus outside the casing 150 is input into the controller 60. The controller 60 outputs image data to be printed to the image former 110 on the basis of the received image data. The image former 110 forms an image based on the output image data.

The server apparatus 200 and the image processing apparatus 100 are connected via a signal line or the like (not illustrated), and exchange the mutual sensor values of the respective apparatuses or data used for the operations of the apparatuses as needed. The image processing apparatus 100 and the server apparatus 200 have separate power supplies, respectively, and can independently operate. The server apparatus 200 has a basic property that it always operates to receive accesses from a client apparatus via a network.

The server apparatus 200 is connected to a network and performs predetermined processings. Specifically, the server apparatus 200 functions as e-mail server, Web server, application server, file server, print server, and the like, and performs the processings (such as various dynamic processings including data saving and data organization and various response processings) based on the predefined computer programs in response to a request of a client apparatus or the like.

The entire outer shape of the server apparatus 200 is substantially a cuboid shape. The server apparatus 200 has a front face 200F, a back face 200B, a right side face 200R, a left side face 200L, an upward face 200U (see FIG. 2) and a downward face 200D.

The server apparatus 200 includes a casing 200C, a server main body 230, and a fan 240 as its components. The server main body 230 is configured of a motherboard, a CPU, a recording apparatus (such as HDD or SSD), a network interface (IF), a heat sink and a power supply.

A coupling section 250 couples part of the downward face 150D of the image processing apparatus 100 and part of the upward face 200U of the server apparatus 200. Thereby, the image processing apparatus 100 and the server apparatus 200 are integrally configured.

Figure 3:
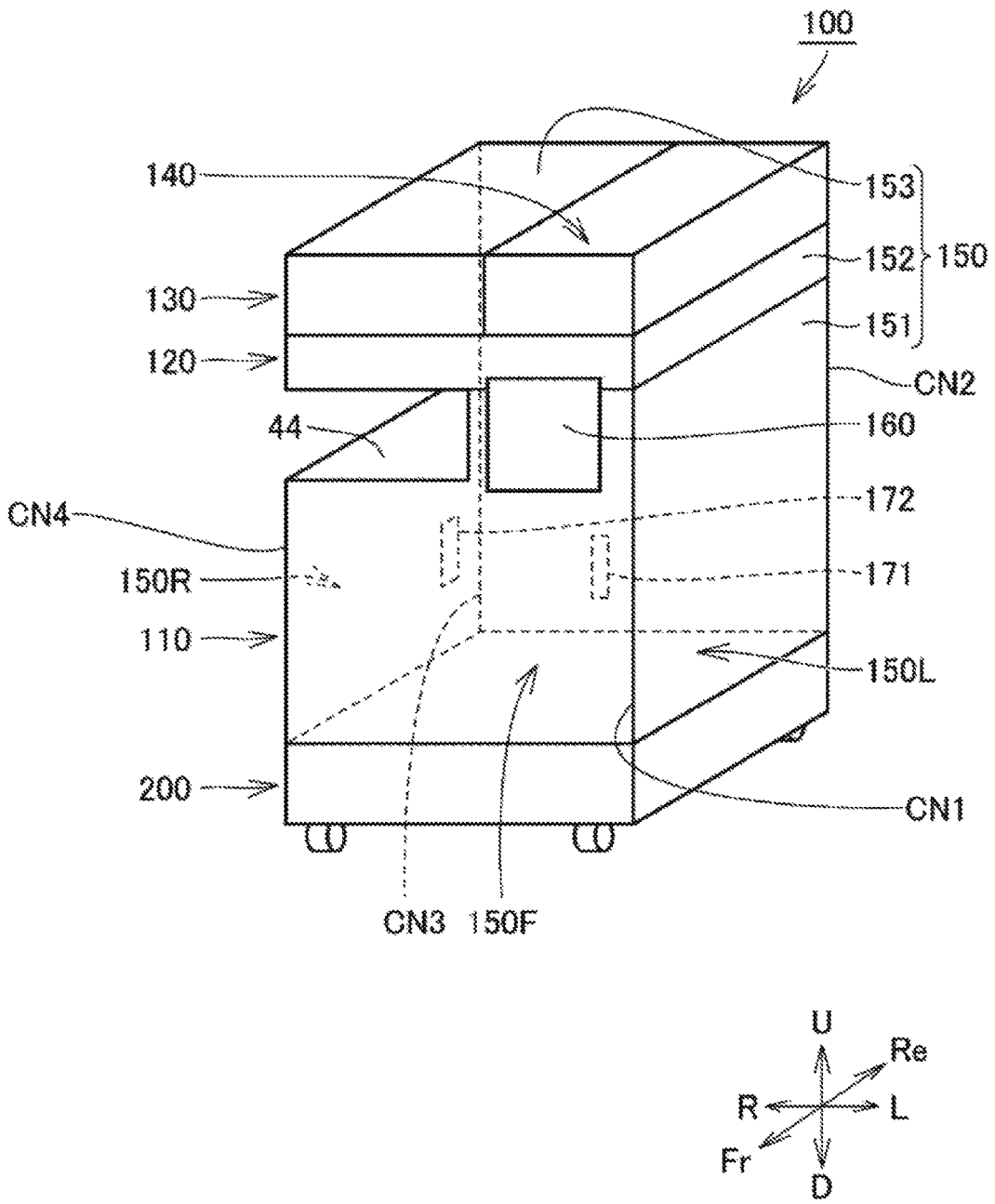
FIG. 3 is a schematic perspective view of the image processing apparatus according to the first embodiment.
Figure 4:
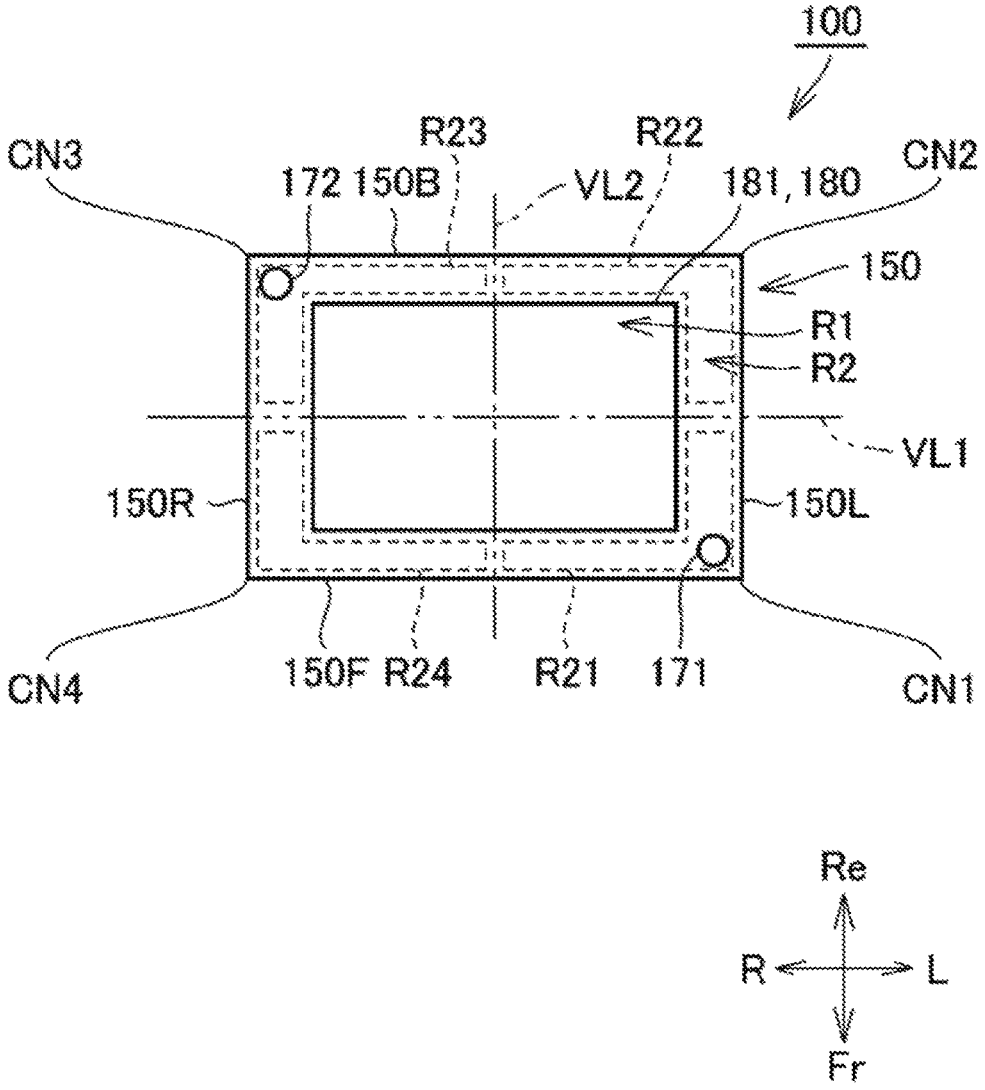
FIG. 4 is a schematic cross-sectional view illustrating an arrangement of a first antenna and a second antenna in the image processing apparatus according to the first embodiment.

FIG. 3 is a schematic perspective view of the image processing apparatus according to the first embodiment. FIG. 4 is a schematic cross-sectional view illustrating an arrangement of the first antenna and the second antenna in the image processing apparatus according to the first embodiment. An arrangement of the first antenna 171 and the second antenna 172 will be described with reference to FIG. 3 and FIG. 4.

As illustrated in FIG. 3 and FIG. 4, the first antenna 171 and the second antenna 172 are arranged at the first corner closest to the first antenna 171 and the second corner closest to the second antenna 172, respectively.

Specifically, as vertically viewed, the first antenna 171 is arranged such that the distance to the corner CN1 (the first corner) is shorter than the distances to the corners CN2, CN3, and CN4. The second antenna 172 is arranged such that the distance to the corner CN3 (the second corner) is shorter than the distances to the corners CN1, CN2, and CN4 as vertically viewed.

The peripheries (the front face 150F and the left side face 150L) of the casing 150 which are mutually adjacent to form the corner CN1 and the peripheries (the back face 150B and the right side face 150R) of the casing 150 which are mutually adjacent to form the corner CN3 are mutually different.

As illustrated in FIG. 4, as vertically viewed, the first shield member 181 defines a space inside the first casing part 151 into a first region R1 and a second region R2 surrounding the first region R1.

The first antenna 171 and the second antenna 172 are arranged outside the first shield member 181 as vertically viewed. Specifically, the first antenna 171 and the second antenna 172 are arranged in the second region R2.

The first antenna 171 and the second antenna 172 are arranged to be shielded by the first shield member 181. As vertically viewed, a line connecting the center of the first antenna 171 and the center of the second antenna 172 passes through the first shield member 181 between the first antenna 171 and the second antenna 172.

As vertically viewed, when the second region R2 is divided into four regions R21, R22, R23, and R24 by a first virtual line VL1 passing through the center of the casing 150 and orthogonal to the vertical direction and a second virtual line VL2 passing through the center of the casing 150 and orthogonal to the vertical direction and the first virtual line VL1, the first antenna 171 and the second antenna 172 are arranged in the regions diagonally positioned among the four divided regions, respectively. Specifically, the first antenna 171 is arranged in the region R21 and the second antenna 172 is arranged in the region R23.

More specifically, the first antenna 171 and the second antenna 172 are arranged at the corners diagonally positioned among the four corners CN1, CN2, CN3, and CN4.

Figure 5:
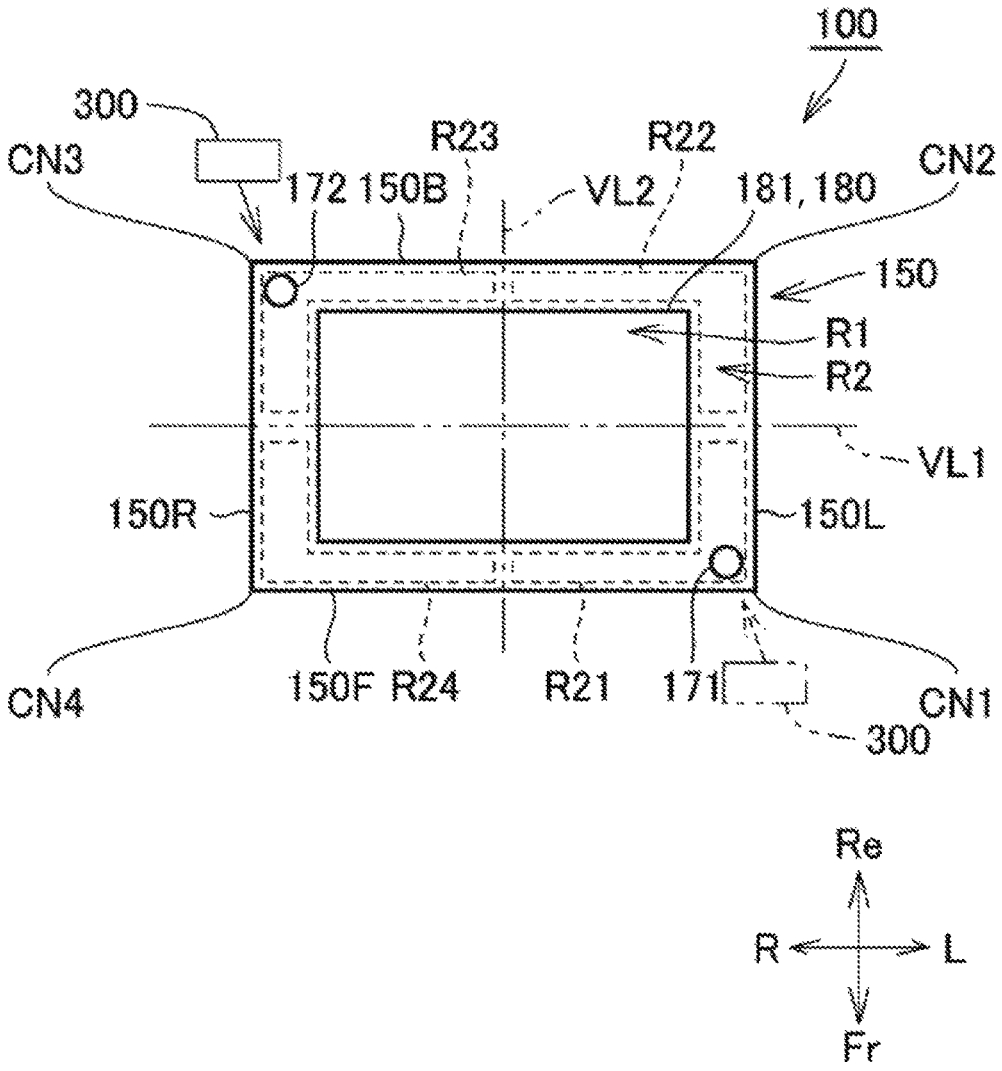
FIG. 5 is a diagram for explaining communication between the first antenna or the second antenna and a communication apparatus outside a casing in the image processing apparatus according to the first embodiment.

FIG. 5 is a diagram for explaining communication between the first antenna or the second antenna and a communication apparatus outside the casing in the image processing apparatus according to the first embodiment. Communication between the first antenna 171 or the second antenna 172 and a communication apparatus 300 outside the casing 150 will be described with reference to FIG. 5.

As described above, the first antenna 171 and the second antenna 172 are arranged at the first corner (corner CN1) closest to the first antenna 171 and the second corner (corner CN3) closest to the second antenna 172, respectively.

Further, the peripheries (the front face 150F and the left side face 150L) of the casing 150 which are mutually adjacent to form the corner CN1 and the peripheries (the back face 150B and the right side face 150R) of the casing 150 which are mutually adjacent to form the corner CN3 are mutually different.

Thereby, even when the communication apparatus 300 outside the casing 150 is arranged on either side of a line connecting the first antenna 171 and the second antenna 172 as vertically viewed, communication with the communication apparatus 300 can be made via an antenna closer to the communication apparatus 300. Thereby, accuracy of communication can be enhanced.

Specifically, when the communication apparatus 300 is positioned closer to the corner CN1, the communication apparatus 300 can make communication with the first antenna 171, and when the communication apparatus 300 is positioned closer to the corner CN3, the communication apparatus 300 can make communication with the second antenna 172.

As described above, the first antenna 171 and the second antenna 172 are arranged to be shielded by the shield member 180. Also in this case, even when the communication apparatus 300 outside the casing 150 is arranged on either side of a line connecting the first antenna 171 and the second antenna 172 as vertically viewed, communication with the communication apparatus 300 can be made via an antenna closer to the communication apparatus 300. Thereby, accuracy of communication can be enhanced.

Specifically, when the communication apparatus 300 is positioned closer to the corner CN1, the communication apparatus 300 can make communication with the first antenna 171, and when the communication apparatus 300 is positioned closer to the corner CN3, the communication apparatus 300 can make communication with the second antenna 172.

As described above, the image processing apparatus 100 according to the first embodiment can enhance accuracy of communication.

Comparative Example

Figure 6:
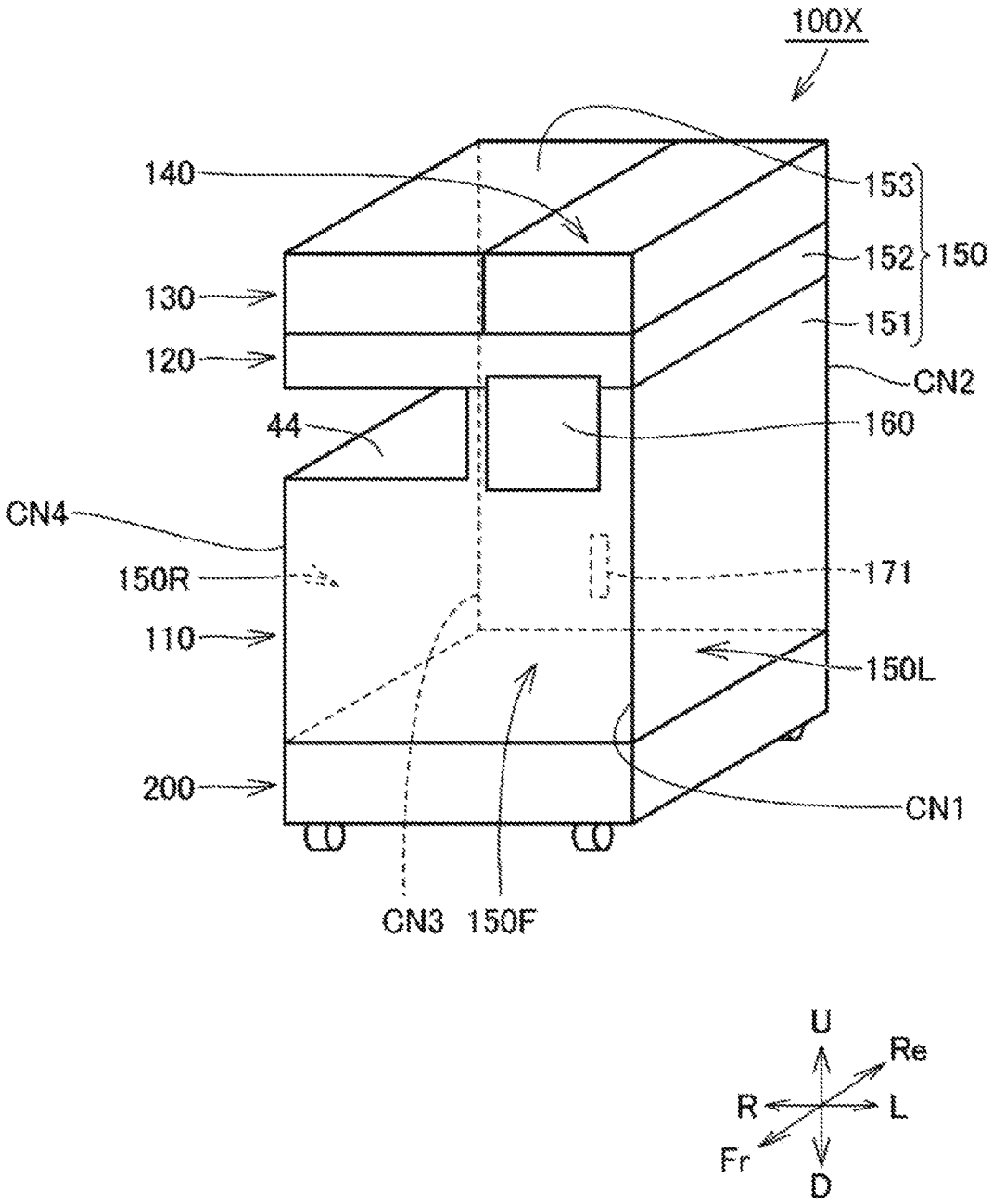
FIG. 6 is a schematic perspective view of an image processing apparatus according to a comparative example.
Figure 7:
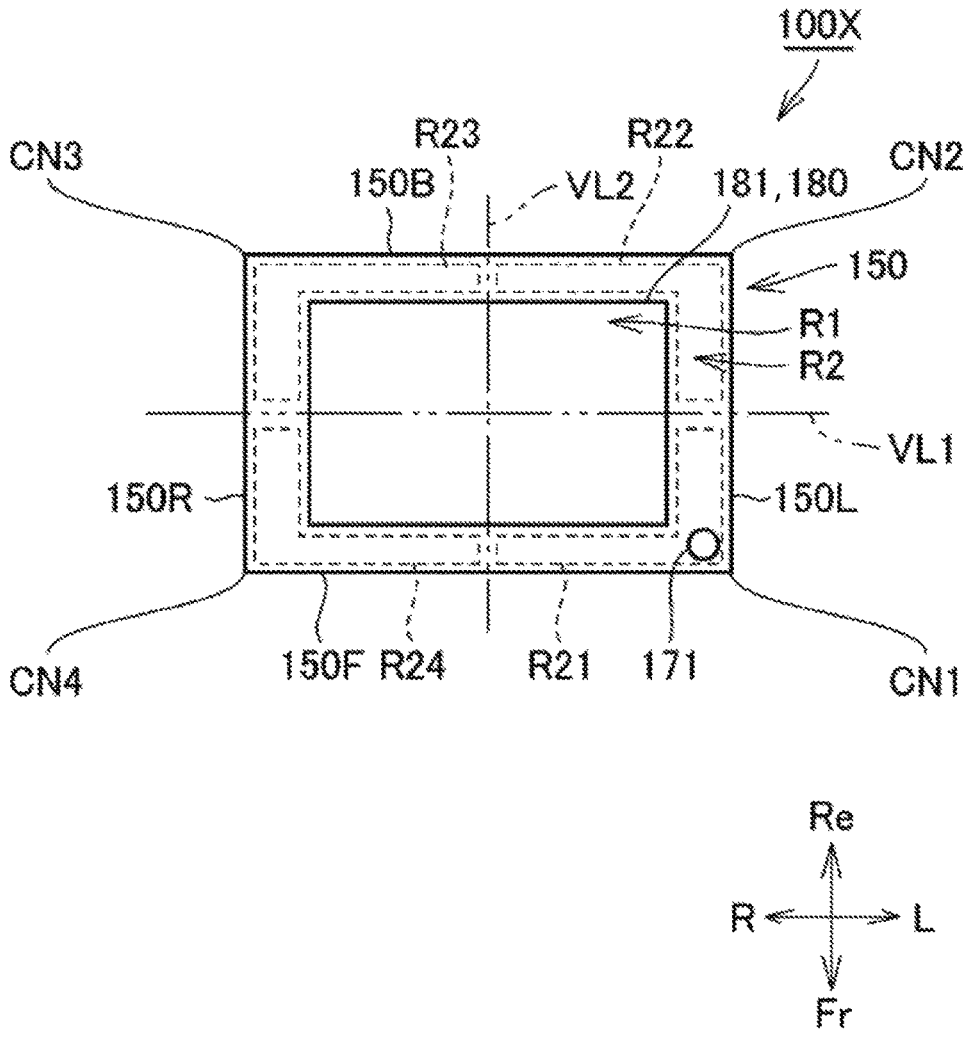
FIG. 7 is a schematic cross-sectional view illustrating an arrangement of the first antenna in the image processing apparatus according to the comparative example.

FIG. 6 is a schematic perspective view of an image processing apparatus according to a comparative example. FIG. 7 is a schematic cross-sectional view illustrating an arrangement of the first antenna in the image processing apparatus according to the comparative example. An image processing apparatus 100X according to the comparative example will be described with reference to FIG. 6 and FIG. 7.

As illustrated in FIG. 6 and FIG. 7, the image processing apparatus 100X according to the comparative example is different from the image processing apparatus 100 according to the first embodiment in that only the first antenna 171 is provided as an antenna. Other constituents are almost similar.

The first antenna 171 is arranged in the second region R2 inside the first casing part 151. The first antenna 171 is arranged at a shorter distance to the corner CN1 than to the corners CN2, CN3, and CN4 as vertically viewed. The first antenna 171 is provided only on the front side of the casing 150.

Figure 8:
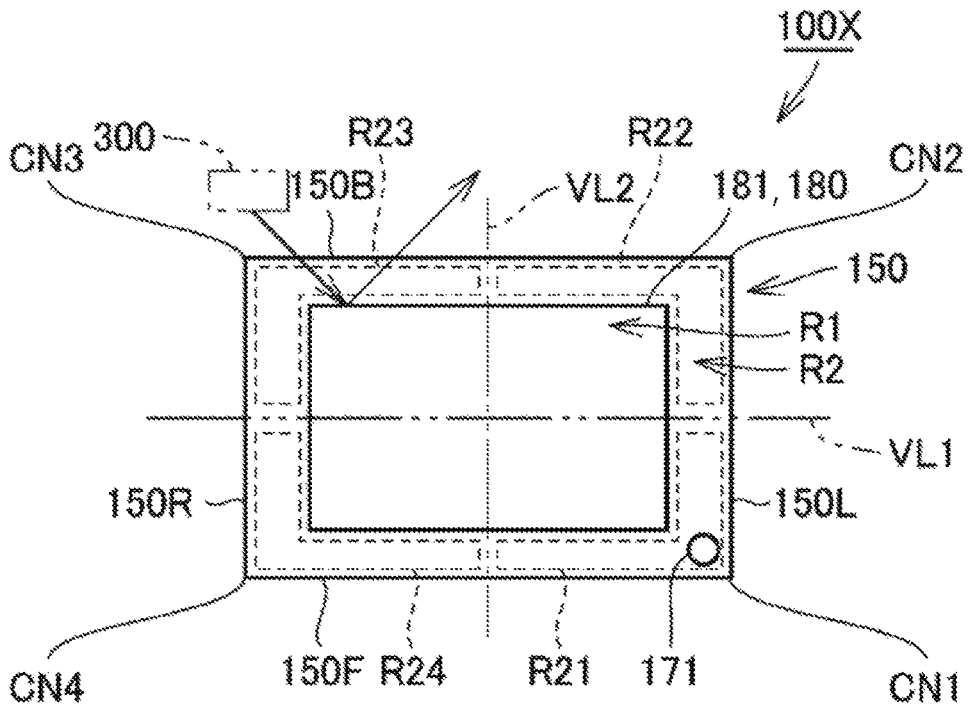
FIG. 8 is a diagram for explaining communication between the first antenna and a communication apparatus outside the casing in the image processing apparatus according to the comparative example.

FIG. 8 is a diagram for explaining communication between the first antenna and a communication apparatus outside the casing in the image processing apparatus according to the comparative example. Communication between the first antenna 171 and the communication apparatus 300 outside the casing 150 will be described with reference to FIG. 8.

As illustrated in FIG. 8, when the communication apparatus 300 is positioned behind the image processing apparatus 100X, a signal transmitted from the communication apparatus 300 is shielded by the first shield member 181.

In this way, when the single first antenna 171 is arranged only on one side of the casing 150, communication with the communication apparatus 300 positioned at the other side of the casing 150 opposite to the one side is difficult.

Second Embodiment

Figure 9:
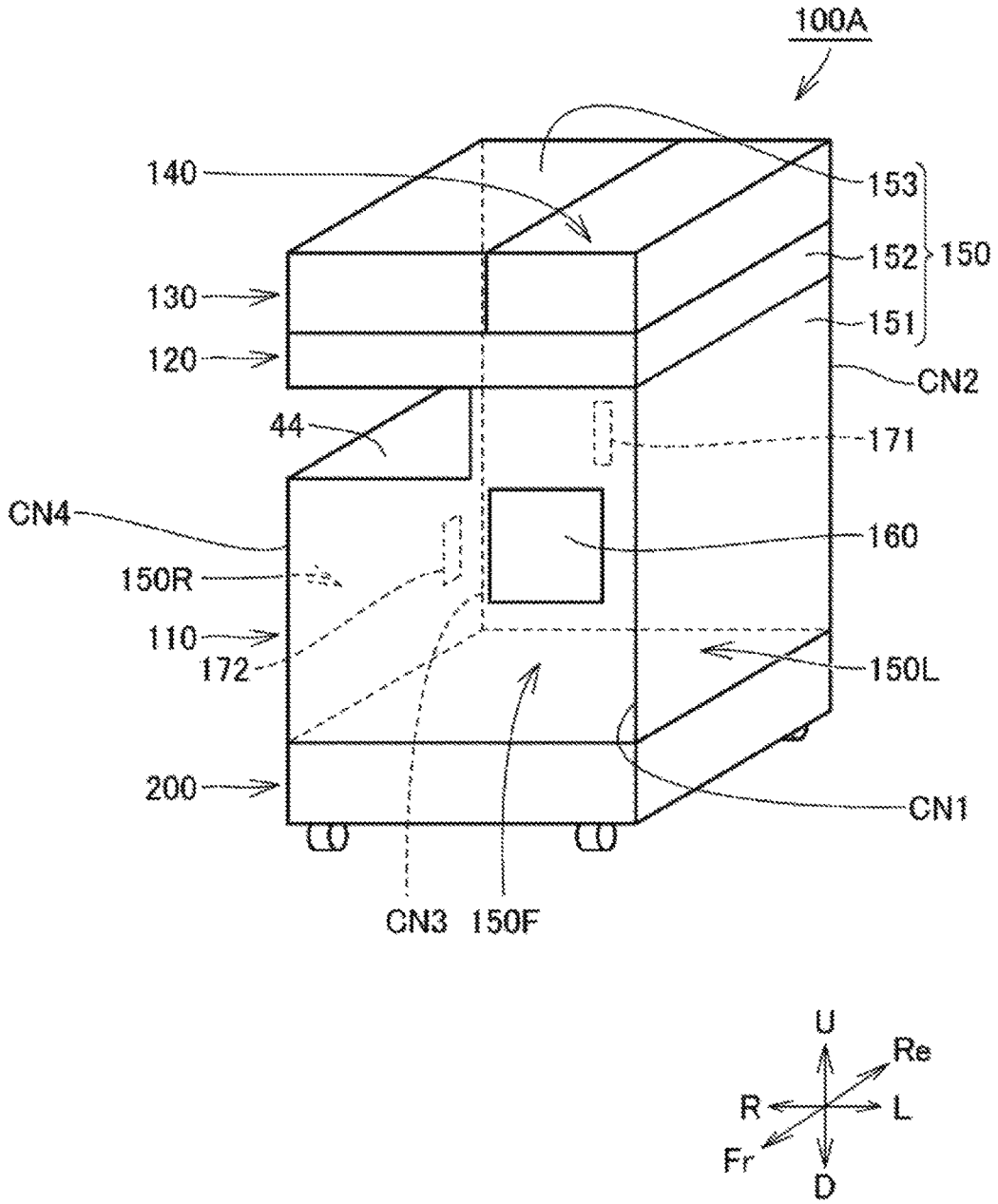
FIG. 9 is a schematic perspective view of an image processing apparatus according to a second embodiment.

FIG. 9 is a schematic perspective view of an image processing apparatus according to a second embodiment. An image processing apparatus 100A according to the second embodiment will be described with reference to FIG. 9.

As illustrated in FIG. 9, the image processing apparatus 100A according to the second embodiment is different from the image processing apparatus 100 according to the first embodiment in a positional relationship between the first antenna 171 and the operation panel 160. Other constituents are almost similar.

The first antenna 171 is arranged above the operation panel 160. The operation panel 160 is arranged substantially at the center of the first casing part 151 in the vertical direction, for example. The operation panel 160 is arranged such that a user can touch the operation face while the user stands up with his/her hands down in consideration of operability of the user. The hands of the user can easily reach above the operation panel 160. Thereby, when a portable communication terminal such as Smartphone is used as a communication apparatus outside the casing 150, the communication apparatus can be easily approximated to the first antenna 171.

Also in the second embodiment, the first antenna 171 and the second antenna 172 are arranged almost similarly as in the first embodiment as vertically viewed. Thereby, the substantially similar effects as in the first embodiment can be obtained also in the second embodiment.

Additionally, the first antenna 171 is arranged above the operation panel 160, and thus a user can easily approximate a portable communication terminal to the first antenna 171. Thereby, accuracy of communication can be enhanced and convenience can be enhanced.

The second embodiment has been described assuming that the first antenna 171 is arranged above the operation panel 160 and the second antenna 172 is arranged below the upper end of the operation panel 160, but is not limited thereto. For example, both the first antenna 171 and the second antenna 172 may be arranged above the operation panel 160, and the second antenna 172 may be arranged above the operation panel 160 while the first antenna 171 may be arranged below the upper end of the operation panel 160.

Third Embodiment

Figure 10:
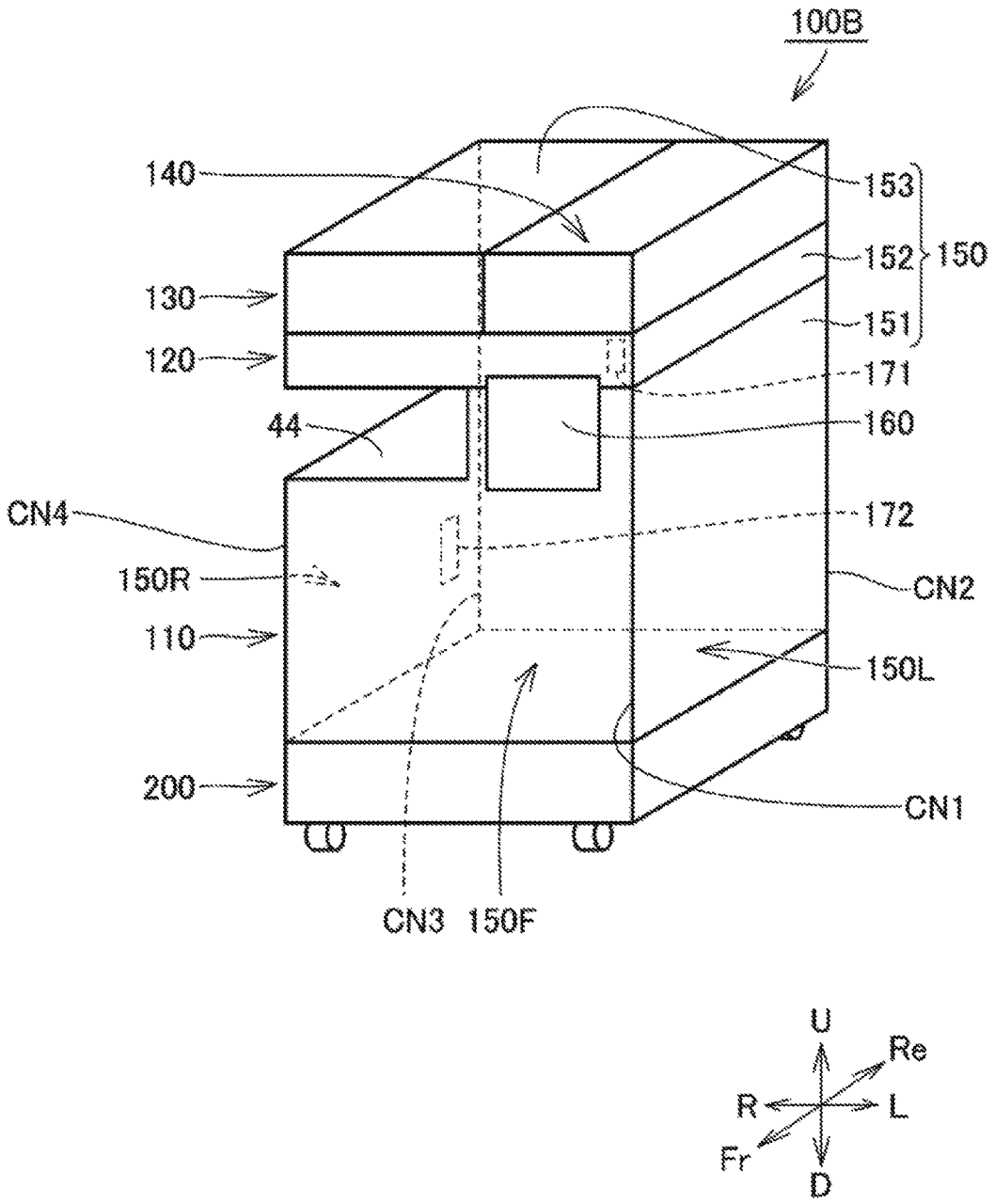
FIG. 10 is a schematic perspective view of an image processing apparatus according to a third embodiment.

FIG. 10 is a schematic perspective view of an image processing apparatus according to a third embodiment. An image processing apparatus 100B according to the third embodiment will be described with reference to FIG. 10.

As illustrated in FIG. 10, the image processing apparatus 100B according to the third embodiment is different from the image processing apparatus 100 according to the first embodiment in a position of the first antenna 171. Other constituents are almost similar.

The first antenna 171 and the second antenna 172 are arranged at the first corner (corner CN1) closest to the first antenna 171 and the second corner (corner CN3) closest to the second antenna 172, respectively.

The peripheries (the front face 150F and the left side face 150L) of the casing 150 which are mutually adjacent to form the corner CN1 and the peripheries (the back face 150B and the right side face 150R) of the casing 150 which are mutually adjacent to form the corner CN3 are mutually different.

As described above, the first antenna 171 and the second antenna 172 are arranged to be shielded by the shield member 180 as vertically viewed.

Specifically, the first antenna 171 is provided closer to the second casing part 152. The first antenna 171 is arranged closer to the second casing part 152 at a shorter distance to the corner CN1 than to the corners CN2, CN3, and CN4 as vertically viewed.

Also in the second casing part 152, a space inside the second casing part 152 is defined into a first region and a second region surrounding the first region by the second shield member 182 as vertically viewed.

The first antenna 171 is arranged in the second region in the second casing part 152. As described above, the outer shape of the first casing part 151 almost matches with the outer shape of the second casing part 152 as vertically viewed. Thereby, the center of the first casing part 151 almost matches with the center of the second casing part 152 as vertically viewed.

Thus, also in the third embodiment, when the second region R2 is divided into four regions by a first virtual line passing through the center of the casing 150 and orthogonal to the vertical direction and a second virtual line passing through the center of the casing 150 and orthogonal to the vertical direction and the first virtual line as vertically viewed, the first antenna 171 and the second antenna 172 are arranged in the regions diagonally positioned among the four divided regions.

The operation panel 160 is arranged such that a user can touch the operation face while the user stands up with his/her elbows bent in consideration of operability of the user. Thus, the hands of the user can reach the second casing part 152 positioned closer to the upper end of the operation panel 160. Thereby, when a portable communication terminal such as Smartphone is used as a communication apparatus outside the casing 150, the communication apparatus can be easily approximated to the first antenna 171.

As described above, also in the third embodiment, the first antenna 171 and the second antenna 172 are arranged almost similarly as in the first embodiment as vertically viewed. Thereby, the substantially similar effects as in the first embodiment can be obtained also in the third embodiment.

Additionally, the first antenna 171 is provided closer to the second casing part 152, and thus a user can easily approximate a portable communication terminal to the first antenna 171. Thereby, accuracy of communication can be enhanced and convenience can be enhanced.

The third embodiment has been described assuming that the first antenna 171 is arranged closer to the second casing part 152 and the second antenna 172 is arranged closer to the first casing part 151, but is not limited thereto. Both the first antenna 171 and the second antenna 172 may be provided closer to the second casing part 152. Further, the first antenna 171 may be provided closer to the first casing part 151 while the second antenna 172 may be provided closer to the second casing part 152.

Fourth Embodiment

Figure 11:
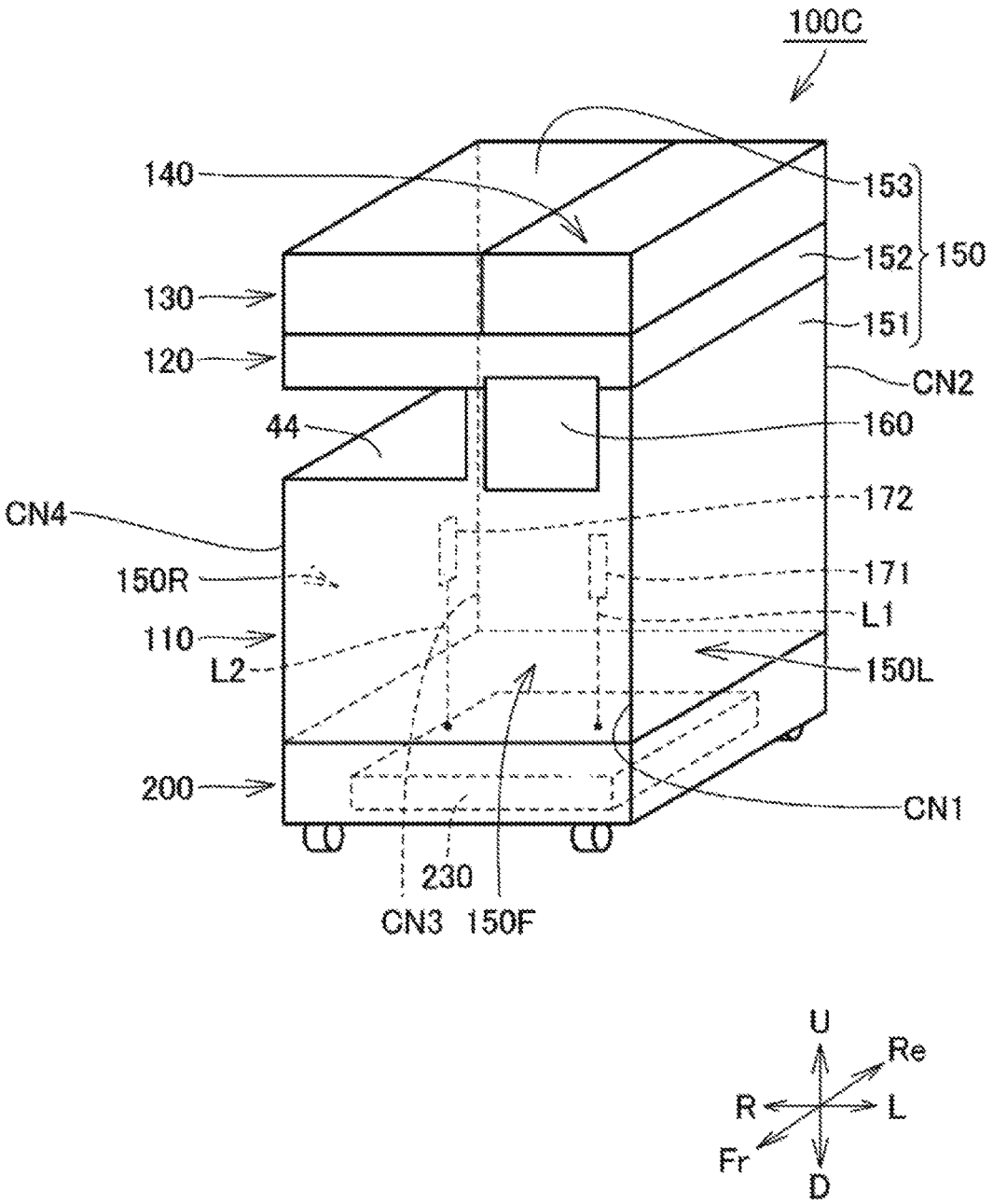
FIG. 11 is a schematic perspective view of an image processing apparatus according to a fourth embodiment.

FIG. 11 is a schematic perspective view of an image processing apparatus according to a fourth embodiment. An image processing apparatus 100C according to the fourth embodiment will be described with reference to FIG. 11.

As illustrated in FIG. 11, the image processing apparatus 100C according to the fourth embodiment is different from the image processing apparatus 100 according to the first embodiment in that the first antenna 171 and the second antenna 172 are connected to the server main body 230 of the server apparatus 200 via wirings L1 and L2, respectively. Other constituents are almost similar.

The server apparatus 200 is arranged below the casing 150, and the first antenna 171 and the second antenna 172 are arranged above the server apparatus 200.

The server apparatus 200 has the positional relationship with the first antenna 171 and the second antenna 172, and thus the casing 150 is positioned higher by the height of the server apparatus 200. Thereby, a user can easily approximate a communication apparatus such as portable communication terminal to the first antenna 171 or the second antenna 172.

Also in the fourth embodiment, the first antenna 171 and the second antenna 172 are arranged almost similarly as in the first embodiment as vertically viewed. Thereby, the substantially similar effects as in the first embodiment can be obtained also in the fourth embodiment.

Additionally, the first antenna 171 and the second antenna 172 are connected to the server main body 230 of the server apparatus 200 via the wirings L1 and L2, respectively, and thus communication data received from a communication apparatus outside the casing 150 can be sent to the server main body 230 via the first antenna 171 and/or the second antenna 172. Communication data input from the server apparatus 200 into the first antenna 171 and/or the second antenna 172 can be transmitted to the communication apparatus outside the casing 150.

Fifth Embodiment

Figure 12:
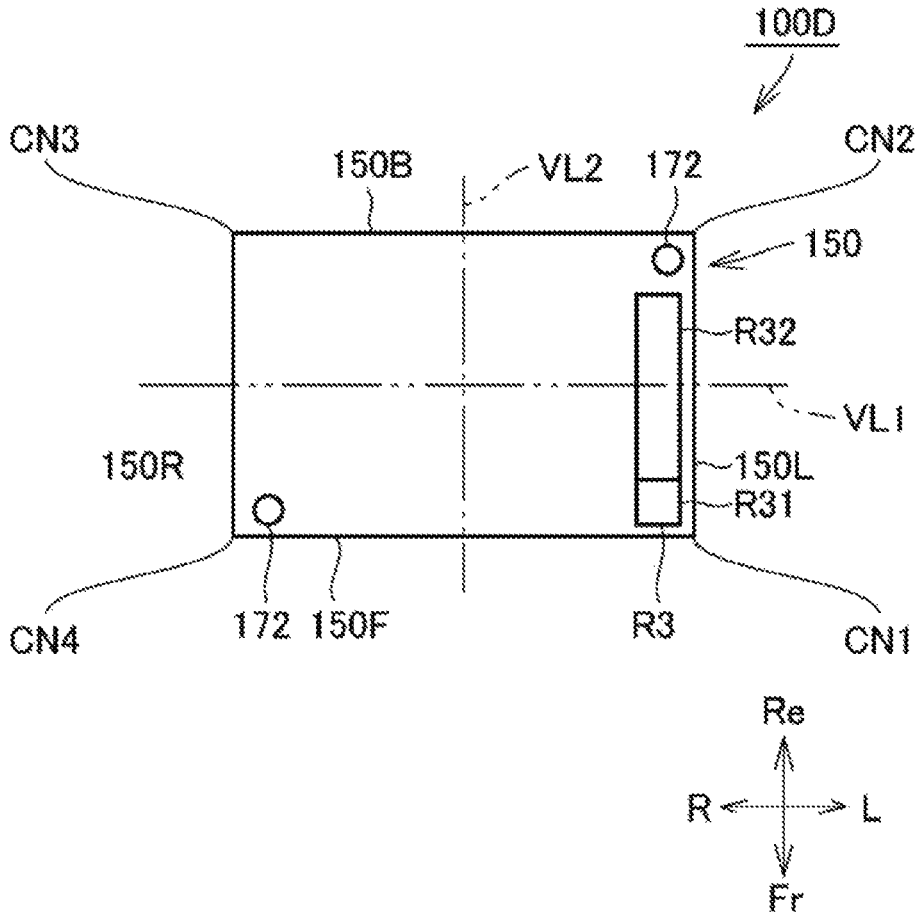
FIG. 12 is a schematic cross-sectional view illustrating an arrangement of the first antenna and the second antenna in an image processing apparatus according to a fifth embodiment.

FIG. 12 is a schematic cross-sectional view illustrating an arrangement of the first antenna and the second antenna in an image processing apparatus according to a fifth embodiment. The shield member 180 is omitted in FIG. 12 for convenience. An image processing apparatus 100D according to the fifth embodiment will be described with reference to FIG. 12.

As illustrated in FIG. 12, the image processing apparatus 100D according to the fifth embodiment is different from the image processing apparatus 100 according to the first embodiment in that a positional relationship between an installation region R3 in which a plurality of feeding rollers and a driver that drives the feeding rollers are installed, and the first antenna 171 and the second antenna 172 is specified as follows. Other constituents are almost similar.

The casing 150 has a rectangular shape as vertically viewed. The installation region R3 in which a plurality of feeding rollers (not illustrated) and a driver (not illustrated) that drives the feeding rollers are installed is provided inside the first casing part 151 of the casing 150.

The installation region R3 extends along one side out of the four sides forming the rectangular shape as vertically viewed. Specifically, the installation region R3 extends along the left side face 150L as vertically viewed. That is, the installation region R3 extends in the front-back direction.

The installation region R3 has a second installation region R32 in which the feeding rollers are mainly arranged and a first installation region R31 in which the driver is installed. As vertically viewed, the first installation region R31 and the second installation region R32 are arranged side by side along one side out of the four sides forming the rectangular shape. The driver is arranged in the installation region R3 at one end in a direction in which the installation region R3 extends.

One end of the installation region R3 is arranged at the corner CN1 out of the four corners CN1, CN2, CN3, and CN4.

The second antenna 172 is arranged at the corner CN2 opposite to the one end of the installation region R3. The first antenna 171 is arranged at the corner CN4 diagonal to the corner CN2 where the second antenna 172 is arranged.

Also in the fifth embodiment, the first antenna 171 and the second antenna 172 are arranged almost similarly as in the first embodiment as vertically viewed. Thereby, the substantially similar effects as in the first embodiment can be obtained also in the fifth embodiment.

The driver may discharge an electromagnetic wave. Thus, the second antenna 172 is arranged opposite to the driver, thereby restricting the second antenna 172 from being influenced by an electromagnetic wave from the driver. Thereby, accuracy of communication can be further enhanced.

Sixth Embodiment

Figure 13:
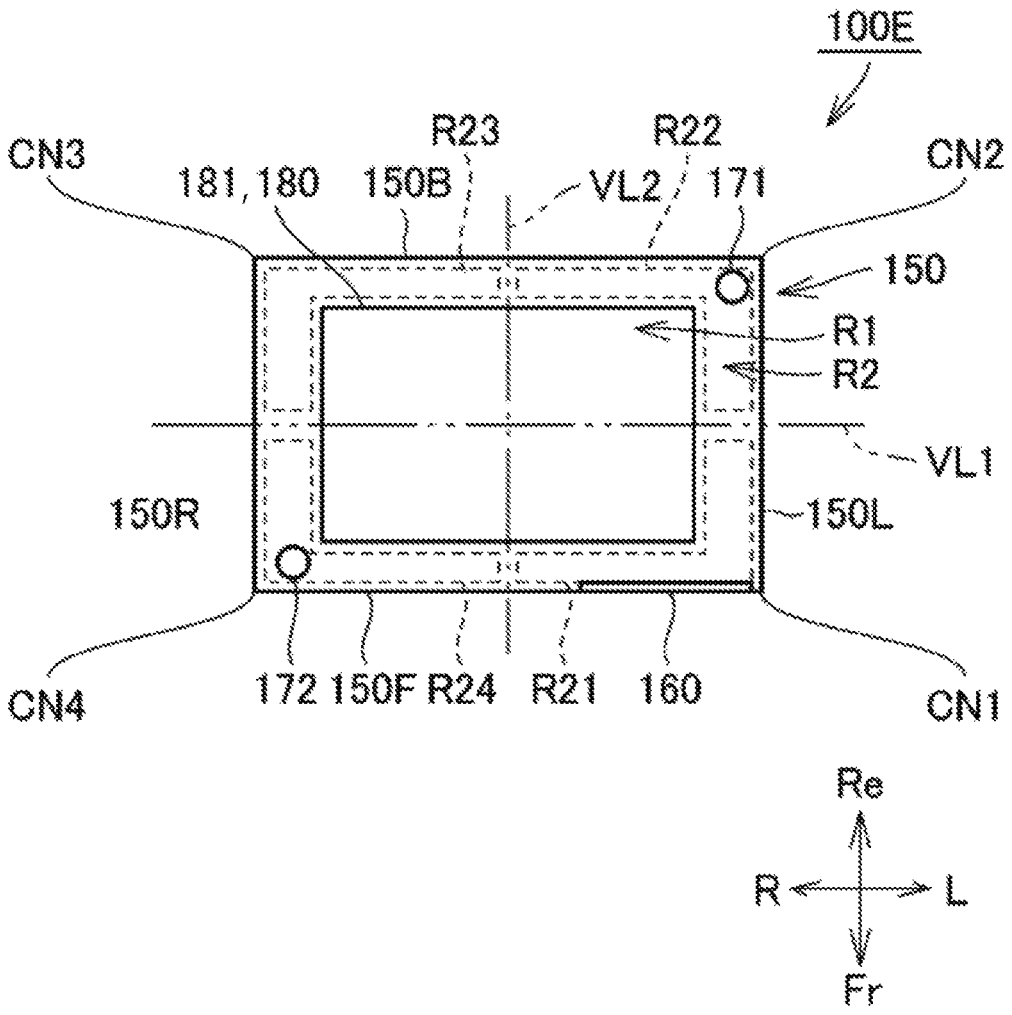
FIG. 13 is a schematic cross-sectional view illustrating an arrangement of the first antenna and the second antenna in an image processing apparatus according to a sixth embodiment.

FIG. 13 is a schematic cross-sectional view illustrating an arrangement of the first antenna and the second antenna in an image processing apparatus according to a sixth embodiment. An image processing apparatus 100E according to the sixth embodiment will be described with reference to FIG. 13.

As illustrated in FIG. 13, the image processing apparatus 100E according to the sixth embodiment is different from the image processing apparatus 100 according to the first embodiment in a positional relationship of the first antenna 171 and the second antenna 172 relative to the operation panel 160. Other constituents are almost similar.

The operation panel 160 is arranged closest to the corner CN1 among the four corners CN1, CN2, CN3, and CN4.

The first antenna 171 and the second antenna 172 are arranged at the corners CN2 and CN4 which are different from the closest corner CN1 to the operation panel 160 and are diagonally positioned, respectively.

As described above, the first antenna 171 and the second antenna 172 are arranged almost similarly as in the first embodiment also in the sixth embodiment as vertically viewed. Thereby, the substantially similar effects as in the first embodiment can be obtained also in the sixth embodiment.

Additionally, the first antenna 171 and the second antenna 172 are arranged at the corners CN2 and CN4 which are different from the closest corner CN1 to the operation panel 160 and are diagonally arranged, respectively, as described above, thereby to be restricted from being influence by an electromagnetic wave from a panel board included in the operation panel 160. Thereby, accuracy of communication can be further enhanced.

Seventh Embodiment

Figure 14:
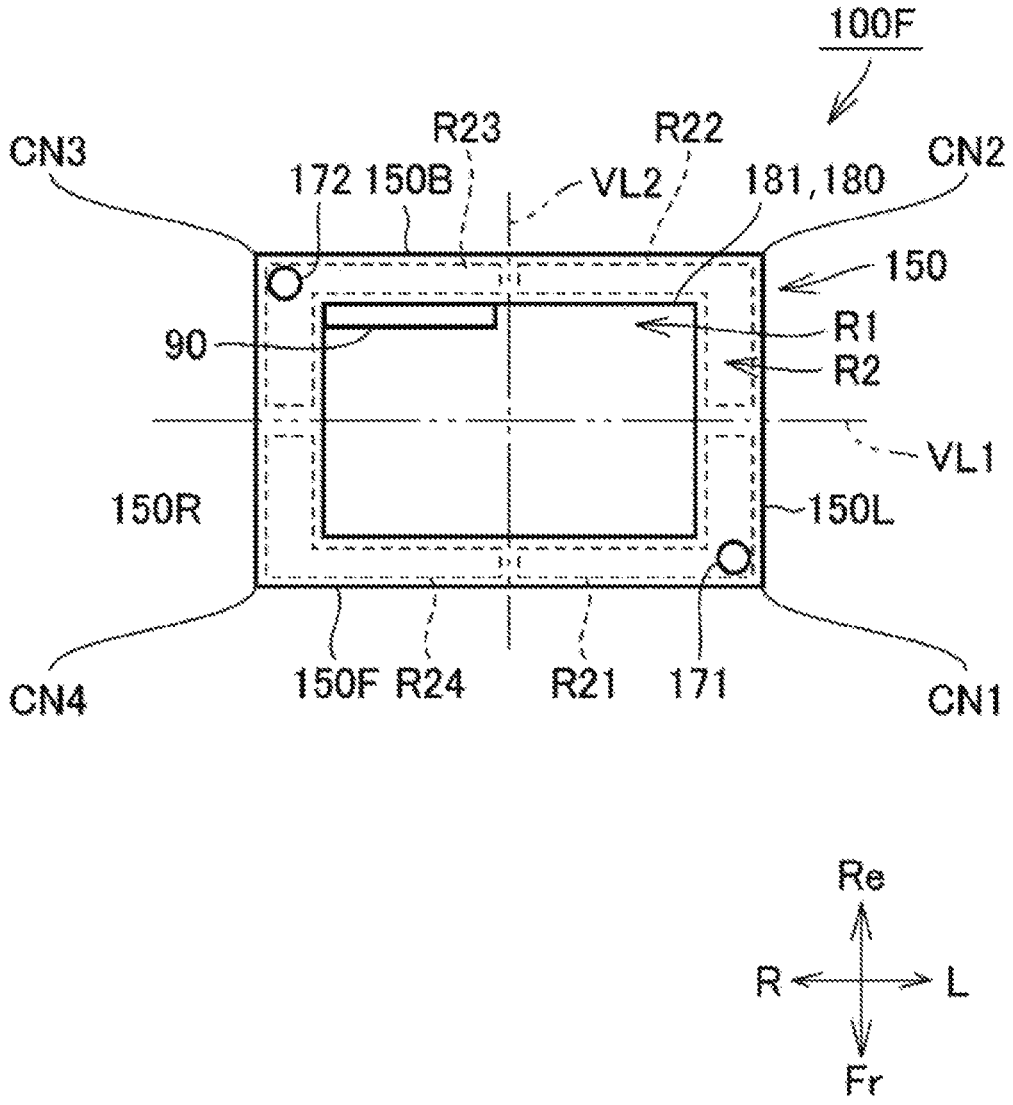
FIG. 14 is a schematic cross-sectional view illustrating an arrangement of the first antenna and the second antenna in an image processing apparatus according to a seventh embodiment.

FIG. 14 is a schematic cross-sectional view illustrating an arrangement of the first antenna and the second antenna in an image processing apparatus according to a seventh embodiment. An image processing apparatus 100F according to the seventh embodiment will be described with reference to FIG. 14.

As illustrated in FIG. 14, the image processing apparatus 100F according to the seventh embodiment is different from the image processing apparatus 100 according to the first embodiment in that a positional relationship between an electronic component 90 that is arranged in the first region R1 and generates an electromagnetic wave, and the first antenna 171 and the second antenna 172 is specified as follows. Other constituents are almost similar.

The electronic component 90 that is arranged in the first region R1 and generates an electromagnetic wave is a circuit board such as high-voltage circuit board and control circuit board. The high-voltage circuit board supplies the image former 110 with power. The control circuit board controls the operations of the image former 110.

The electronic component 90 is arranged closest to the corner CN4 among the four corners CN1, CN2, CN3, and CN4. The second antenna 172 is arranged at the closest corner CN4 to the electronic component 90. The first antenna 171 is arranged at the corner CN1 positioned diagonal to the corner CN4.

As described above, the first antenna 171 and the second antenna 172 are arranged almost similarly as in the first embodiment also in the seventh embodiment as vertically viewed. Thereby, the substantially similar effects as in the first embodiment can be obtained also in the seventh embodiment.

The electronic component 90 is arranged in the first region R1 inside the shield member 180, and thus an electromagnetic wave generated by the electronic component 90 can be restricted from leaking to the outside of the shield member 180.

Eighth Embodiment

Figure 15:
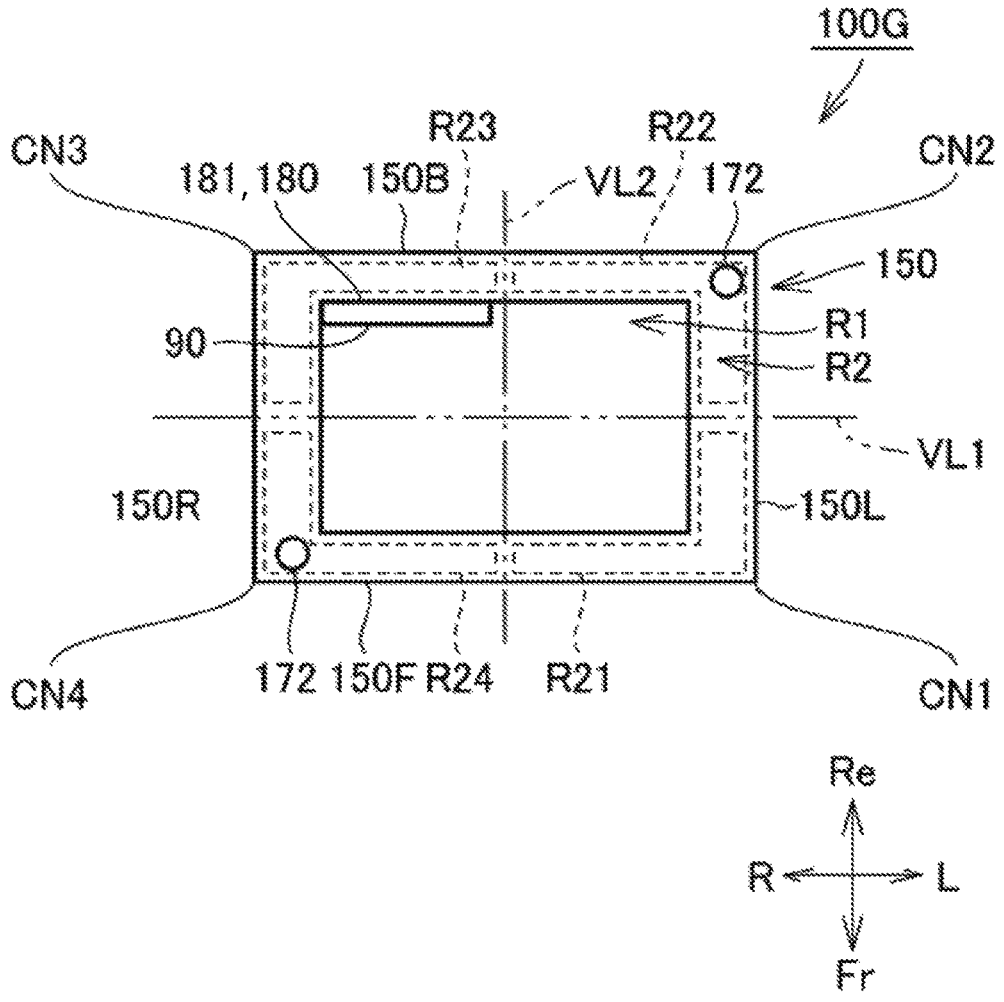
FIG. 15 is a schematic cross-sectional view illustrating an arrangement of the first antenna and the second antenna in an image processing apparatus according to an eighth embodiment.

FIG. 15 is a schematic cross-sectional view illustrating an arrangement of the first antenna and the second antenna in an image processing apparatus according to an eighth embodiment. An image processing apparatus 100G according to the eighth embodiment will be described with reference to FIG. 15.

As illustrated in FIG. 15, the image processing apparatus 100G according to the eighth embodiment is different from the image processing apparatus 100 according to the first embodiment in that a positional relationship between the electronic component 90 that is arranged in the first region R1 and generates an electromagnetic wave, and the first antenna 171 and the second antenna 172 is specified as follows. Other constituents are almost similar.

The electronic component 90 that is arranged in the first region R1 and generates an electromagnetic wave is a circuit board such as high-voltage circuit board and control circuit board.

The electronic component 90 is arranged closest to the corner CN3 among the four corners CN1, CN2, CN3, and CN4, for example. The first antenna 171 and the second antenna 172 are arranged at the corners CN2 and CN4 which are different from the closest corner CN3 to the electronic component 90 and are diagonal to each other, respectively.

As described above, the first antenna 171 and the second antenna 172 are arranged almost similarly as in the first embodiment also in the eighth embodiment as vertically viewed. Thereby, the substantially similar effects as in the first embodiment can be obtained also in the eighth embodiment.

Additionally, the first antenna 171 and the second antenna 172 are arranged at the corners CN2 and CN4 which are different from the closest corner CN3 to the electronic component 90 and are diagonal to each other, respectively, thereby restricting an influence of an electromagnetic wave even if the electromagnetic wave generated from the electronic component 90 leaks to the outside of the shield member 180. Thereby, accuracy of communication can be further enhanced.

Ninth Embodiment

Figure 16:
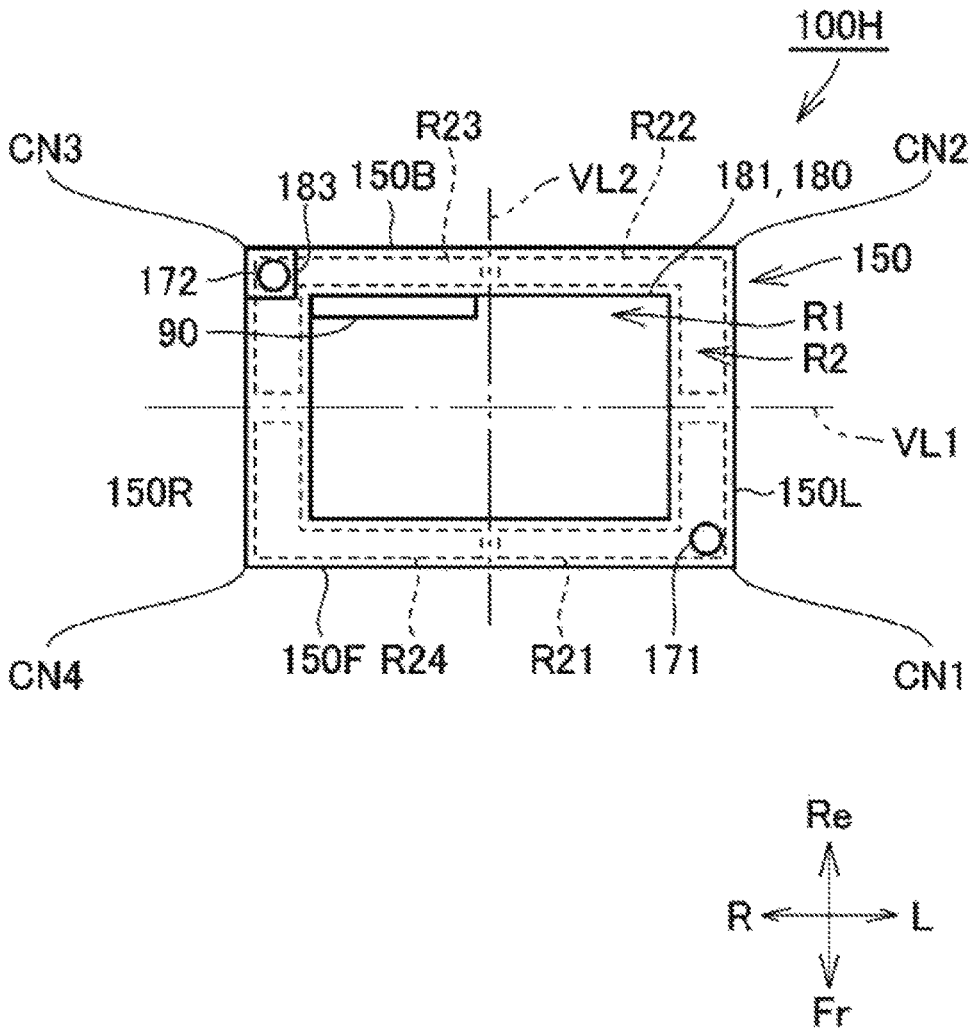
FIG. 16 is a schematic cross-sectional view illustrating an arrangement of the first antenna and the second antenna in an image processing apparatus according to a ninth embodiment.

FIG. 16 is a schematic cross-sectional view illustrating an arrangement of the first antenna and the second antenna in an image processing apparatus according to a ninth embodiment. An image processing apparatus 100H according to the ninth embodiment will be described with reference to FIG. 16.

As illustrated in FIG. 16, the image processing apparatus 100H according to the ninth embodiment is different from the image processing apparatus 100 according to the first embodiment in that a positional relationship between the electronic component 90 that is arranged in the first region R1 and generates an electromagnetic wave, and the first antenna 171 and the second antenna 172 is specified as follows and a cover body 183 is provided. Other constituents are almost similar.

The electronic component 90 that is arranged in the first region R1 and generates an electromagnetic wave is a circuit board such as high-voltage circuit board and control circuit board.

The electronic component 90 is arranged closest to the corner CN3 among the four corners CN1, CN2, CN3, and CN4, for example. The second antenna 172 is arranged at the closest corner CN3 to the electronic component 90. The first antenna 171 is arranged at the corner CN1 diagonal to the corner CN3.

The cover body 183 is substantially L-shaped as vertically viewed. The cover body 183 vertically extends. The cover body 183 is arranged between the second antenna 172 and the first shield member 181. The cover body 183 covers the second antenna 172 from the first shield member 181. The cover body 183 has a shielding property to shield an electromagnetic wave.

As described above, the first antenna 171 and the second antenna 172 are arranged almost similarly as in the first embodiment also in the ninth embodiment as vertically viewed. Thereby, the substantially similar effects as in the first embodiment can be obtained also in the ninth embodiment.

Additionally, the cover body 183 that shields an electromagnetic wave covers the second antenna 172 from the first shield member 181, thereby restricting an electromagnetic wave generated from the electronic component 90 from influencing the second antenna 172 arranged near the electronic component 90 even when the electromagnetic wave leaks to the outside of the shield member 180. Thereby, accuracy of communication can be further enhanced.

The first to ninth embodiments have been described above assuming that the casing 150 has a rectangular shape as vertically viewed and has four peripheries and four corners, but the casing 150 is not limited thereto and may have a polygonal shape as vertically viewed without departing from the spirit of the present invention. In this case, the casing 150 may have three peripheries and three corners, or may have five or more peripheries and five or more corners. The corners of the casing 150 may be rounded or angular.

The first to ninth embodiments have been described above assuming that an image processing apparatus is coupled with the server apparatus 200, but an image processing to apparatus is not limited thereto and may not include the server apparatus 200. An image processing apparatus has been described assuming that it includes an image former and functions as an image forming apparatus, but is not limited thereto, and may not include an image forming function and may be configured to save read images or transmit them to the outside.

Although embodiments of the present invention have been described and illustrated in detail, the disclosed embodiments are made for purposes of illustration and example only and not limitation. The scope of the present invention should be interpreted by terms of the appended claims. The scope of the present invention is intended to include all modifications within the same meaning and range as those of equivalents of the appended claims.

What is claimed is:

1. An image processing apparatus comprising:

a casing that includes a plurality of peripheries and a plurality of corners connecting mutually adjacent peripheries; and a first antenna and a second antenna that are attached on the casing, the first antenna and the second antenna are configured to conduct wireless data communication with external communication devices positioned outside the casing, wherein the first antenna and the second antenna are arranged at a first corner closest to the first antenna and at a second corner closest to the second antenna, respectively, and the mutually adjacent peripheries forming the first corner and the mutually adjacent peripheries forming the second corner are mutually different.

2. The image processing apparatus according to claim 1, wherein the casing includes four peripheries and four corners connecting mutually adjacent peripheries, the casing has a rectangular shape as vertically viewed, and the first antenna and the second antenna are arranged at the mutually diagonal corners.

3. The image processing apparatus according to claim 1, further comprising:

a shield member that shields an electromagnetic wave and defines a space inside the casing into a first region and a second region surrounding the first region as vertically viewed, wherein the first antenna and the second antenna are arranged in the second region and are arranged to be shielded by the shield member.

4. The image processing apparatus according to claim 1, further comprising:

an operation panel provided on the casing, wherein at least one of the first antenna and the second antenna is arranged above the operation panel.

5. The image processing apparatus according to claim 1, wherein the casing includes a first casing part that houses an image former therein and a second casing part that houses an image reader arranged above the image former therein, and at least one of the first antenna and the second antenna is provided closer to the second casing part.

6. The image processing apparatus according to claim 1, which is integrally coupled with a hardware processor that is connected to a network and performs predetermined processings, wherein the first antenna and the second antenna are connected to the hardware processor via wirings, respectively.

7. The image processing apparatus according to claim 6, wherein the hardware processor is arranged below the casing, and the first antenna and the second antenna are arranged above the hardware processor.

8. The image processing apparatus according to claim 1, wherein the casing includes four peripheries and four corners connecting mutually adjacent peripheries, the casing has a rectangular shape as vertically viewed, the first antenna and the second antenna are arranged at the mutually diagonal corners, an installation region in which a plurality of feeding rollers and a driver that drives the feeding rollers are installed is provided inside the casing, the installation region extends along one side out of the four sides forming the rectangular shape as vertically viewed, the installation region is such that the driver is arranged at one end in a direction in which the installation region extends, the one end of the installation region is arranged at any of the four corners, and one of the first antenna and the second antenna is arranged at the corner at the other end of the installation region opposite to the one end of the installation region.

9. The image processing apparatus according to claim 1, further comprising;

an operation panel provided on the casing, wherein the casing includes four peripheries and four corners connecting mutually adjacent peripheries, the casing has a rectangular shape as vertically viewed, the first antenna and the second antenna are arranged at the mutually diagonal corners, respectively, the operation panel is arranged closest to any of the four corners, and the first antenna and the second antenna are arranged at the corners which are different from the closest corner to the operation panel and are mutually diagonal.

10. The image processing apparatus according to claim 1, comprising:

a shield member that shields an electromagnetic wave and defines a space inside the casing into a first region and a second region surrounding the first region as vertically viewed; and an electronic component that is arranged in the first region and generates an electromagnetic wave, wherein the casing includes four peripheries and four corners connecting mutually adjacent peripheries, the casing has a rectangular shape as vertically viewed, the first antenna and the second antenna are arranged at the mutually diagonal corners, respectively, the electronic component is arranged closest to any of the four corners, and the first antenna and the second antenna are arranged at the corners which are different from the closest corner to the electronic component and are mutually diagonal.

11. The image processing apparatus according to claim 10, wherein the electronic component is a circuit board.

12. The image processing apparatus according to claim 1, comprising:

a shield member that shields an electromagnetic wave and defines a space inside the casing into a first region and a second region surrounding the first region as vertically viewed, wherein the casing has four peripheries and four corners connecting mutually adjacent peripheries, the casing has a rectangular shape as vertically viewed, and the first antenna and the second antenna are arranged at the mutually diagonal corners, respectively, and an electronic component that is arranged in the first region and generates an electromagnetic wave, wherein the electronic component is arranged closest to any of the four corners, one of the first antenna and the second antenna is arranged at the closest corner to the electronic component, a cover body that covers the one of the first antenna and the second antenna from the shield member is arranged between the one of the first antenna and the second antenna and the shield member, and the cover body shields an electromagnetic wave.

13. The image processing apparatus according to claim 1, further comprising a server apparatus arranged outside of the casing, the server being connected to a network and performs predefined processings based on computer programs, wherein the server apparatus is one of the external communication devices that conducts wireless data communication with the first antenna and the second antenna.

14. The image processing apparatus according to claim 13, wherein the server apparatus is arranged below said casing.

15. An image processing apparatus comprising:

a casing that includes a plurality of peripheries and a plurality of corners connecting mutually adjacent peripheries; and a first antenna and a second antenna that are attached on the casing, wherein the first antenna and the second antenna are arranged at a first corner closest to the first antenna and at a second corner closest to the second antenna, respectively, and the mutually adjacent peripheries forming the first corner and the mutually adjacent peripheries forming the second corner are mutually different, wherein the casing includes a cassette that houses a recording medium forming an image thereon, and the first antenna and the second antenna are arranged above the cassette.

* * * * *